US009726124B2

(12) United States Patent
Tanaka et al.

(10) Patent No.: US 9,726,124 B2
(45) Date of Patent: Aug. 8, 2017

(54) INTAKE MANIFOLD STRUCTURE FOR ENGINE

(71) Applicant: Mazda Motor Corporation, Hiroshima (JP)

(72) Inventors: Fusatoshi Tanaka, Higashihiroshima (JP); Mikiko Kojo, Aki-gun (JP); Kazuo Iwata, Aki-gun (JP); Tatsunori Kiyomihara, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 86 days.

(21) Appl. No.: 14/824,860

(22) Filed: Aug. 12, 2015

(65) Prior Publication Data

US 2016/0061166 A1 Mar. 3, 2016

(30) Foreign Application Priority Data

Sep. 3, 2014 (JP) ..... 2014-178927

(51) Int. Cl.
*F02M 35/10* (2006.01)
*F02M 25/08* (2006.01)

(52) U.S. Cl.
CPC ... *F02M 35/10222* (2013.01); *F02M 25/0836* (2013.01); *F02M 35/10065* (2013.01); *F02M 35/10321* (2013.01)

(58) Field of Classification Search
USPC ..... 123/184.21, 184.24, 184.26, 184.27, 123/184.38, 184.42, 184.43, 184.44, 123/184.47, 184.48, 184.49
See application file for complete search history.

(56) References Cited

U.S. PATENT DOCUMENTS 5,967,121 A 10/1999 Pirch et al.
5,996,559 A * 12/1999 Busato ..... F02M 25/0836 123/184.21
7,451,732 B1 * 11/2008 Vichinsky ..... F02M 25/089 123/184.42

(Continued)

FOREIGN PATENT DOCUMENTS

JP H11-511228 A 9/1999
JP 2005-226585 A 8/2005
JP 2010-265871 A 11/2010

(Continued)

OTHER PUBLICATIONS

An Office Action; "Notification of Reasons for Refusal," issued by the Japanese Patent Office on Jan. 31, 2017, which corresponds to Japanese Patent Application No. 2014-178927 and is related to U.S. Appl. No. 14/824,860; with English language translation.

*Primary Examiner* — John Kwon
(74) *Attorney, Agent, or Firm* — Studebaker & Brackett PC

(57) ABSTRACT

A structure of an intake manifold (1) for an engine is constituted of divided pieces (10, 20, 30). The structure of the intake manifold includes a gas supply hole (53) formed in a predetermined position of an outer surface of the intake manifold, and configured to supply predetermined gas from the outside, and a gas inlet passage (51) formed in predetermined joint surfaces (10*m*, 20*m*) of the divided pieces (10, 20), and configured to guide the gas supplied through the gas supply hole to a predetermined gas inlet position (11) of an intake passage (E1).

5 Claims, 9 Drawing Sheets

(56) References Cited

U.S. PATENT DOCUMENTS

| | | | | |
|---|---|---|---|---|
| 8,511,289 | B2 * | 8/2013 | Tanikawa ..... | F02M 35/10039 123/184.42 |
| 2014/0076287 | A1 | 3/2014 | Yamamoto et al. | |

FOREIGN PATENT DOCUMENTS

| | | | |
|---|---|---|---|
| JP | 2014-058879 | A | 4/2014 |
| JP | 2014-088854 | A | 5/2014 |
| WO | 2014/068381 | A1 | 5/2014 |

* cited by examiner

INTAKE MANIFOLD STRUCTURE FOR ENGINE

BACKGROUND OF THE INVENTION

Field of the Invention

The present invention relates to a structure of an intake manifold for an engine.

Description of the Related Art

In an engine to be loaded in an automobile or a like vehicle, fuel vapor generated in a fuel tank is introduced to an intake passage in order to prevent diffusion of fuel vapor into the air. Japanese Unexamined Patent Publication No. 2014-58879 discloses a configuration, in which a purge valve for regulating the amount of fuel vapor to be introduced to an intake passage is integrally mounted on an intake manifold, a pipe is provided between the purge valve and downstream of a throttle valve in the intake passage, and purge gas of fuel vapor is introduced from the purge valve to the intake passage via the pipe (particularly see FIG. 1 of the aforementioned publication).

SUMMARY OF THE INVENTION

Extending the pipe to the position where purge gas is introduced on the outside of the intake manifold as described above, however, may increase the cost and the weight of the engine. The aforementioned problem may also occur in the case where blow-by gas or EGR gas is introduced to the intake passage, in addition to the case where purge gas of fuel vapor is introduced.

In view of the above, an object of the present invention is to provide a structure of an intake manifold for an engine, which enables to reduce the cost and the weight of the engine by shortening a pipe for use in introducing purge gas of fuel vapor to an intake passage.

An aspect of the present invention provides a structure of an intake manifold constituted of a plurality of divided pieces for an engine. The structure of the intake manifold includes a gas supply hole formed in a predetermined position of an outer surface of the intake manifold, and configured to supply predetermined gas from the outside of the intake manifold; and a gas inlet passage formed in predetermined joint surfaces of the divided pieces, and configured to guide the gas supplied through the gas supply hole to a predetermined gas inlet position of an intake passage.

The above and other objects, features and advantages of the present invention will be apparent from the following detailed description and the accompanying drawings.

DETAILED DESCRIPTION OF THE PREFERRED EMBODIMENT

Figure 1:
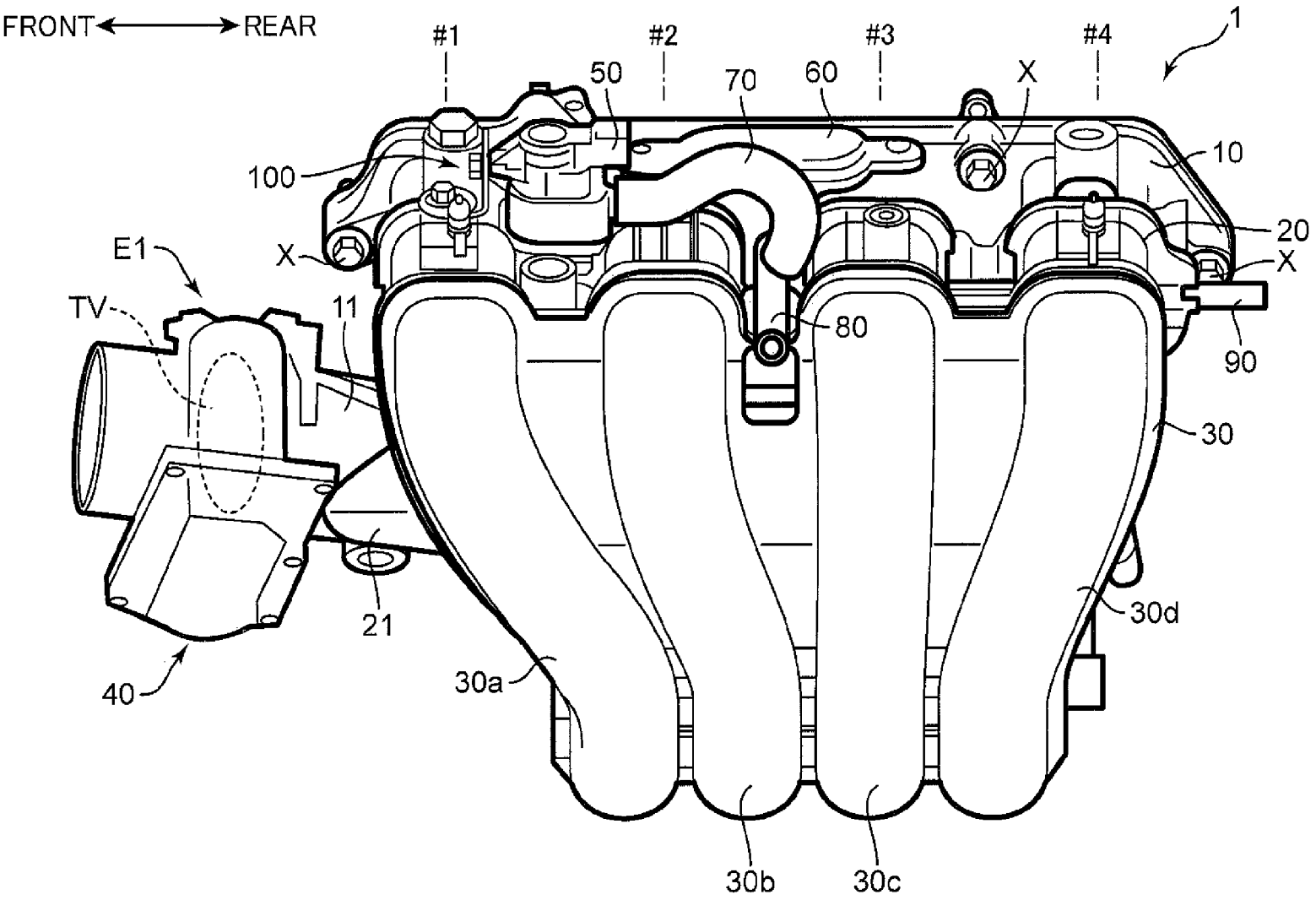
FIG. 1 is a side view of an intake manifold embodying the invention.

In the following, an embodiment of the invention is described referring to the drawings. In FIG. 1 to FIG. 9, front, rear, and left respectively indicate the vehicle front side, the vehicle rear side, and the vehicle left side. Further, in the embodiment, upstream and downstream each indicates the direction of gas flowing through a relevant portion.

First of all, the overall configuration of an intake manifold 1 for an engine in the embodiment is described.

The intake manifold 1 in the embodiment is constituted of three divided pieces 10, 20, and 30 (see FIG. 1). Each of the divided pieces 10, 20, and 30 is a resin molded part, and is integrally molded. The divided pieces 10, 20, and 30 are joined to each other by welding or adhesion. The intake manifold 1 is connected to an in-line 4-cylinder gasoline engine (not illustrated) via a gasket (not illustrated). Although not illustrated, the engine is disposed in a longitudinal posture such that the cylinder array direction is aligned with the vehicle front and rear directions within an engine room located at a vehicle front portion. The intake manifold 1 is disposed on the vehicle left side of the engine. The three divided pieces 10, 20, and 30 (hereinafter, called as the first divided piece 10, the second divided piece 20, and the third divided piece 30) are disposed in this order from the engine side (i.e. from the depth side in FIG. 1) toward the outer side, in other words, from the vehicle right side toward the vehicle left side in a state that the intake manifold 1 is connected to the engine.

A purge valve 50 is mounted on the intake manifold 1 (see FIG. 1 to FIG. 8). The purge valve 50 regulates the amount of fuel vapor to be introduced to an intake passage E1. The purge valve 50 is mounted on a first joint portion S1, which is recessed between runners P1 and P2 of the intake manifold 1 adjacent to each other (see FIG. 3 to FIG. 5). A purge gas supply hole (corresponding to a gas supply hole of the invention) 53 is formed in a predetermined position of an outer surface of the intake manifold 1 (see FIG. 5). Purge gas of fuel vapor to be discharged from the purge valve 50 is supplied through the purge gas supply hole 53 from the outside of the intake manifold 1. A purge passage (corresponding to a gas inlet passage of the invention) 51 is formed in joint surfaces 10*m* and 20*m* of the first and second divided pieces 10 and 20 (see FIG. 4 and FIG. 5). The purge passage 51 guides purge gas of fuel vapor supplied through the purge gas supply hole 53 to a downstream portion (a gas inlet position) of the intake passage E1 with respect to a throttle valve TV.

Figure 4:
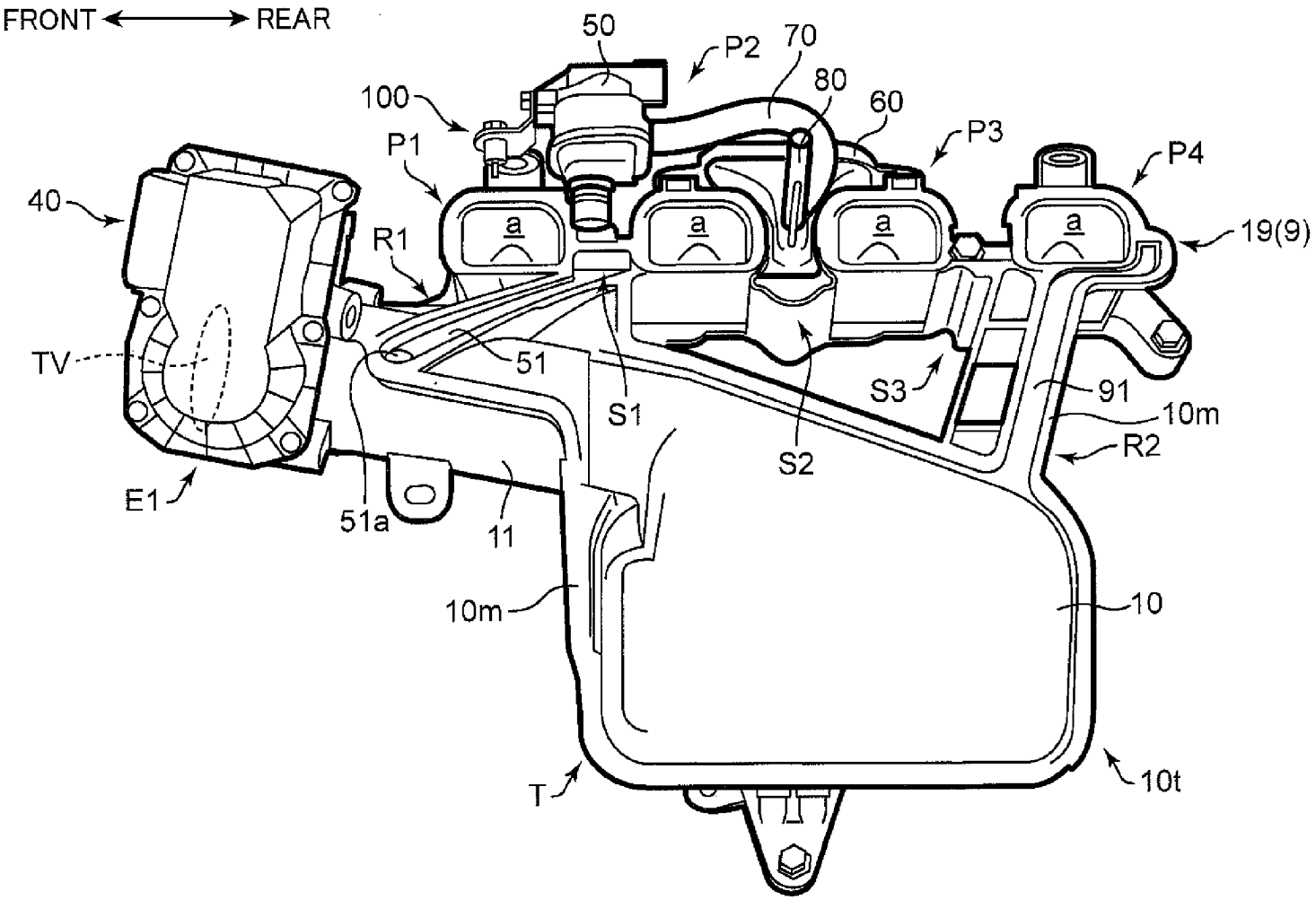
FIG. 4 is a side view of a first divided piece of the intake manifold.
Figure 5:
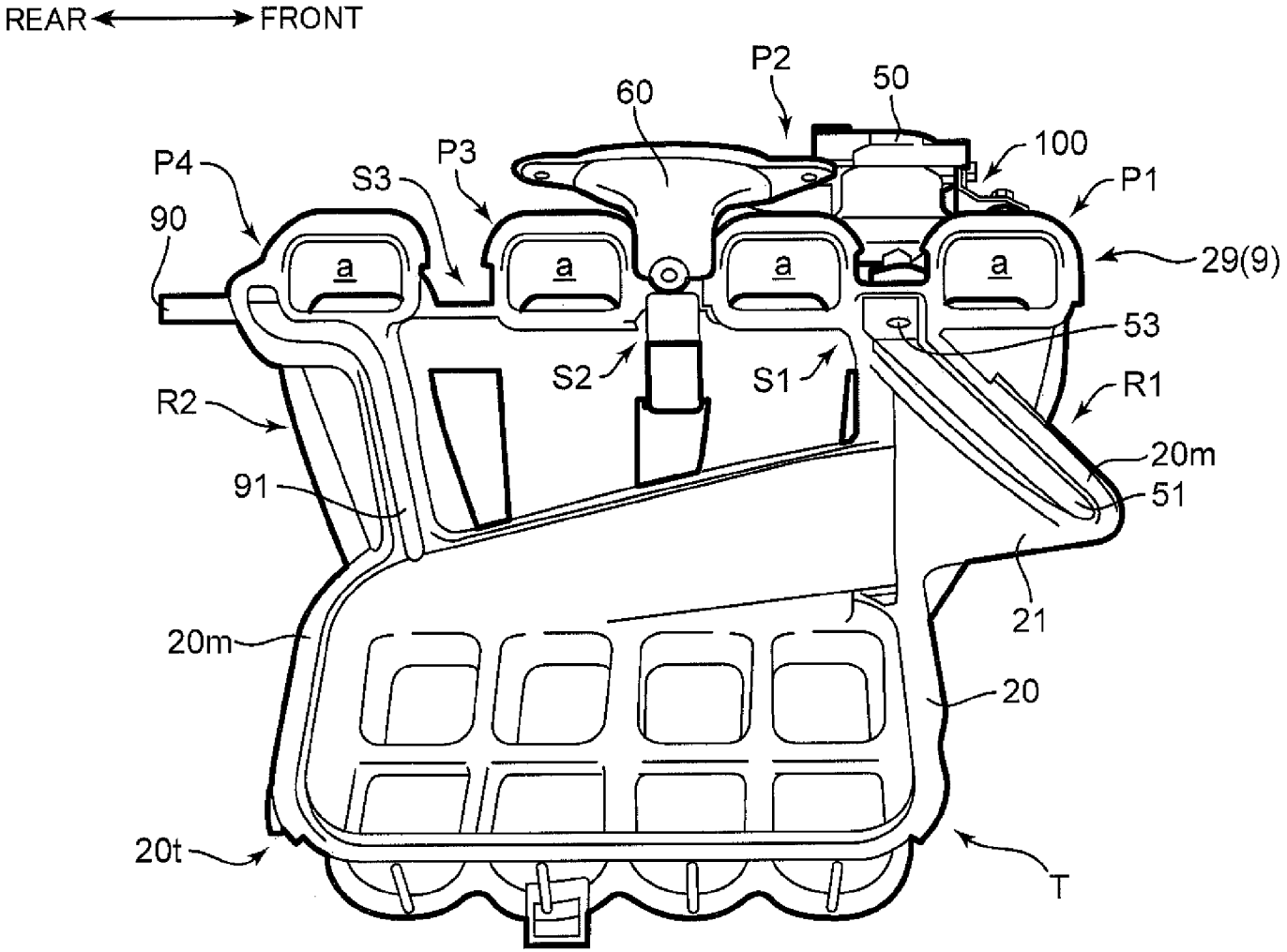
FIG. 5 is a diagram of a second divided piece of the intake manifold when viewed from the engine side.

The intake manifold 1 includes a throttle body 40 provided with the throttle valve TV, a single pipe portion (corresponding to the gas inlet position of the invention) 11 formed downstream of the throttle body 40, and a first connecting portion (corresponding to a connecting portion of the invention) R1 for connecting between the single pipe portion 11 and an engine mounting portion 9 (see FIG. 4 and FIG. 5). The purge gas supply hole 53 is formed in the engine mounting portion 9 (see FIG. 5). The purge passage 51 is formed in the joint surfaces 10*m* and 20*m* of the first and second divided pieces 10 and 20 constituting the first connecting portion R1. Specifically, the purge passage 51 is formed inside the first connecting portion R1 of the intake manifold 1. The first connecting portion R1 is formed into a relatively short columnar shape.

Figure 3:
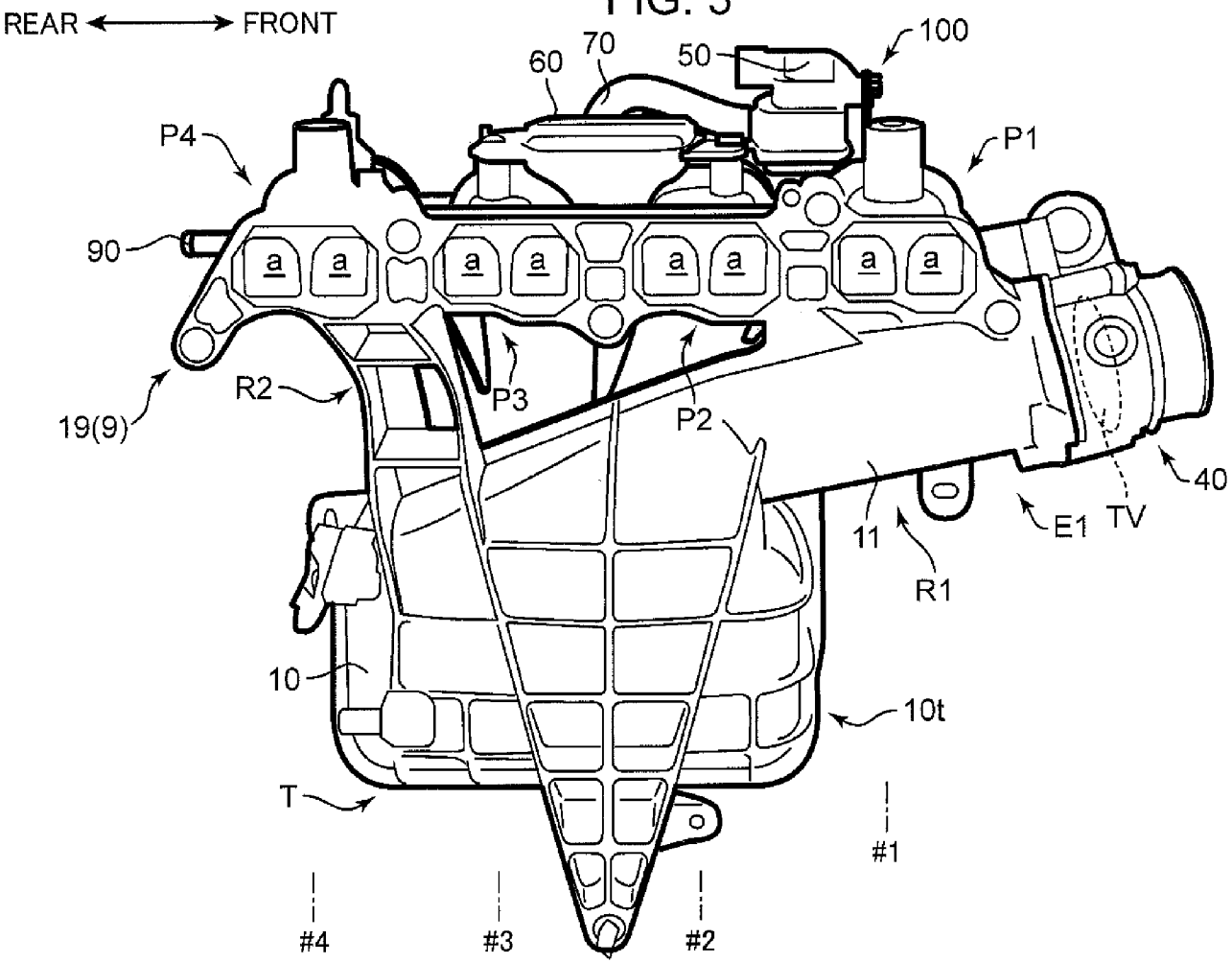
FIG. 3 is a diagram of the intake manifold when viewed from the engine side.

The intake manifold 1 further includes a surge tank T formed downstream of the single pipe portion 11, and a second connecting portion R2 for connecting between the surge tank T and the engine mounting portion 9 (see FIG. 3 and FIG. 4). A communication path 91 for communicating between the surge tank T and the outside of the intake manifold 1 is formed in the joint surfaces 10*m* and 20*m* of the first and second divided pieces 10 and 20 constituting the second connecting portion R2 (see FIG. 4 and FIG. 5). Specifically, the communication path 91 is formed inside the second connecting portion R2 of the intake manifold 1. The second connecting portion R2 is formed into a relatively long columnar shape.

Figure 7:
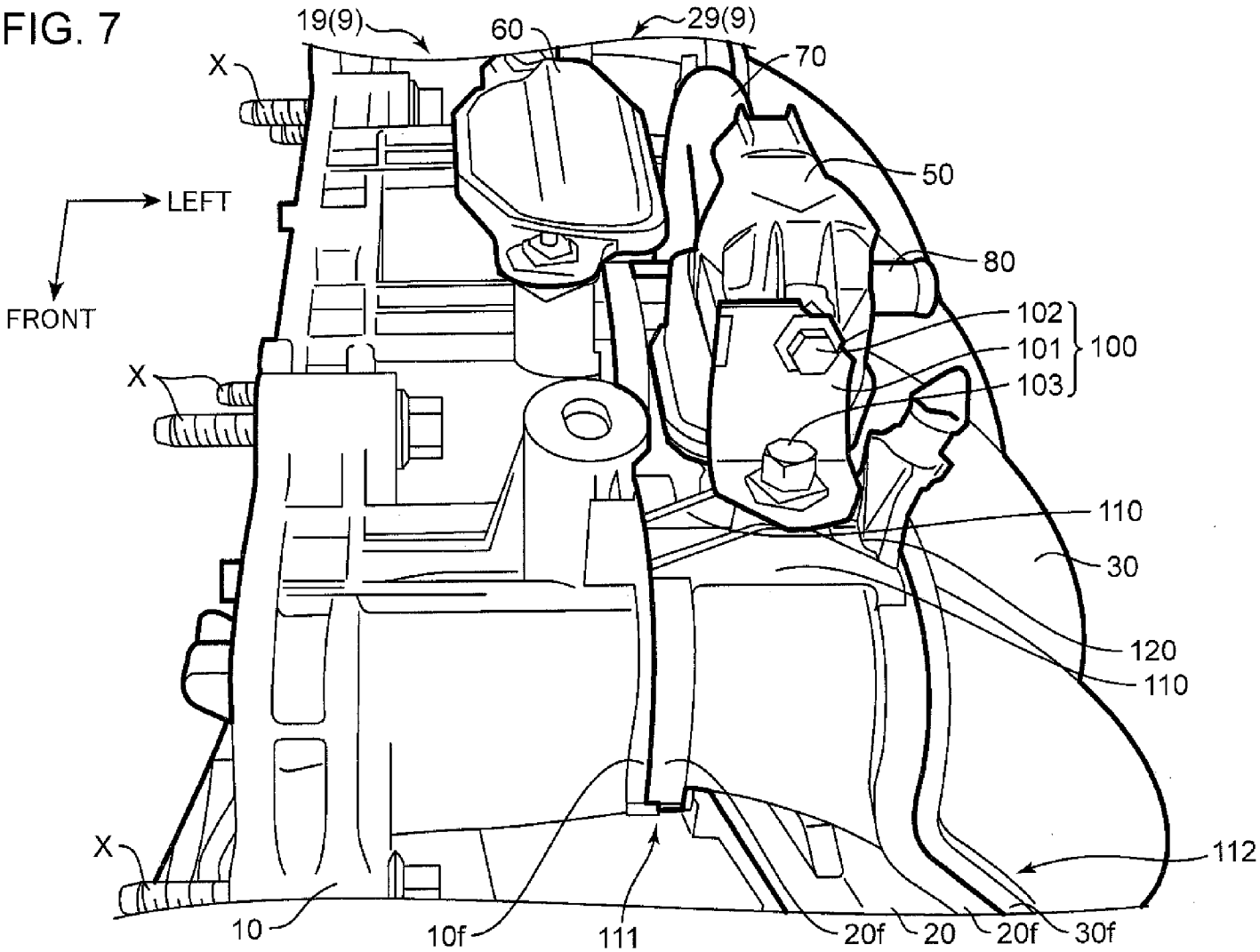
FIG. 7 is a front view of an upper surface of the intake manifold.

A pair of front and rear bridge portions 110 and 110 stand upright on the second divided piece 20 while bridging over a first joint portion 111 formed by joining a joint flange 10*f* of the first divided piece 10 and a second joint flange 20*f* of the second divided piece 20, and a second joint portion 112 formed by joining the joint flange 20*f* of the second divided piece 20 and a joint flange 30*f* of the third divided piece 30; and a fixing portion 120 is integrally formed with the bridge portions 110 and 110 at a position between the bridge portions 110 and 110 (see FIG. 7). The fixing portion 120 and the bridge portions 110, 110 are equivalent to "fixing member" set forth in the appended claims.

Each of the joint flanges 10*f*, 20*f*, and 30*f* is a thick and rigid portion. An L-shaped bracket 101 for fixing the purge valve 50 is provided on the fixing portion 120. Specifically, the purge valve 50 is fixed to the fixing portion 120 of the intake manifold 1 via a fixing mechanism 100 (see FIG. 1 to FIG. 8) including the bracket 101, a first fixing bolt 102, and a second fixing bolt 103. The first fixing bolt 102 of the fixing mechanism 100 connects the bracket 101 to the purge valve 50, and the second fixing bolt 103 of the fixing mechanism 100 connects the bracket 101 to the fixing portion 120.

Figure 8:
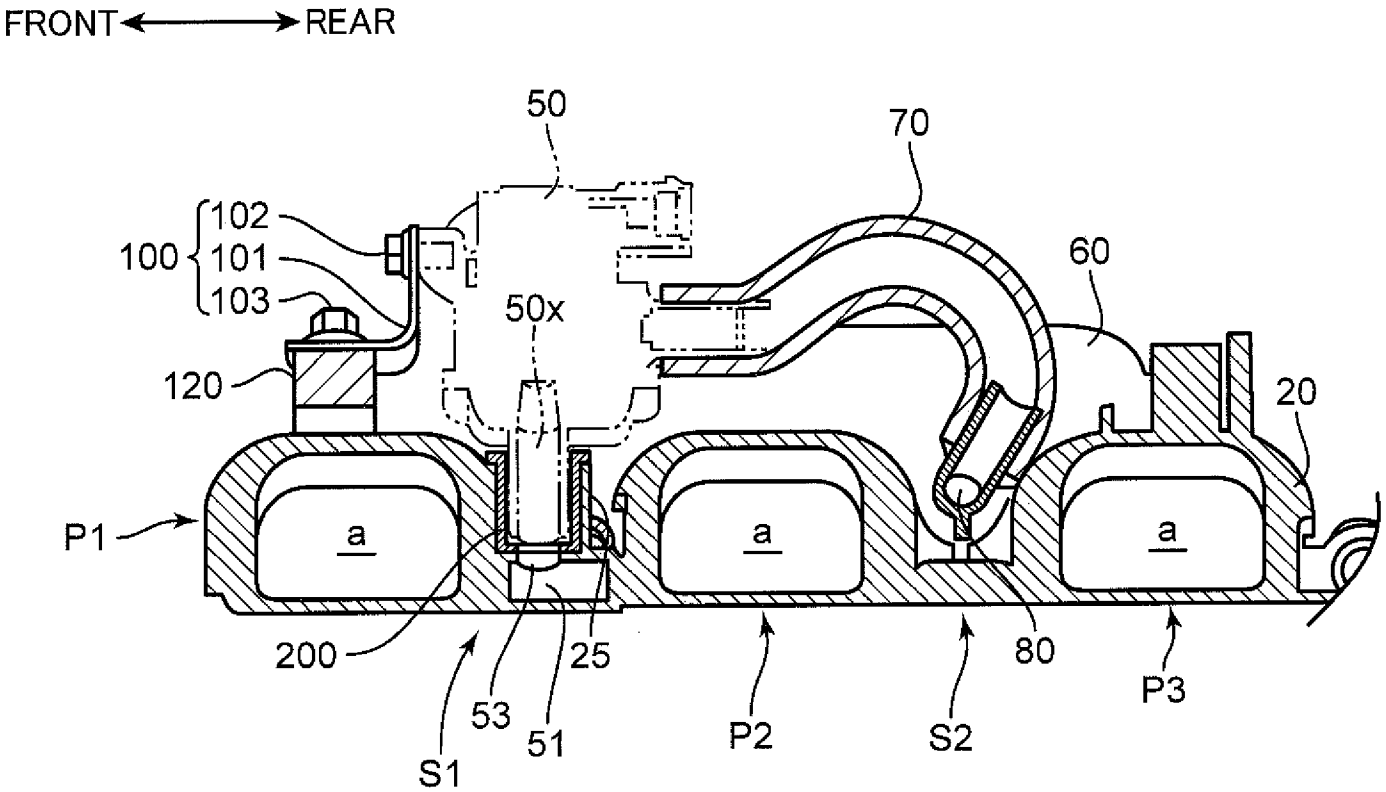
FIG. 8 is a side sectional view of an upper portion of the second divided piece.

The purge valve 50 is mounted on the intake manifold 1 via a cylindrical seal rubber member 200 (see FIG. 8). The seal rubber member 200 includes upper and lower lip portions 201 and 202 on both of the inner surface of the seal rubber member 200 facing the purge valve 50, and the outer surface of the seal rubber member 200 facing the intake manifold 1 (see FIG. 9).

Figure 2:
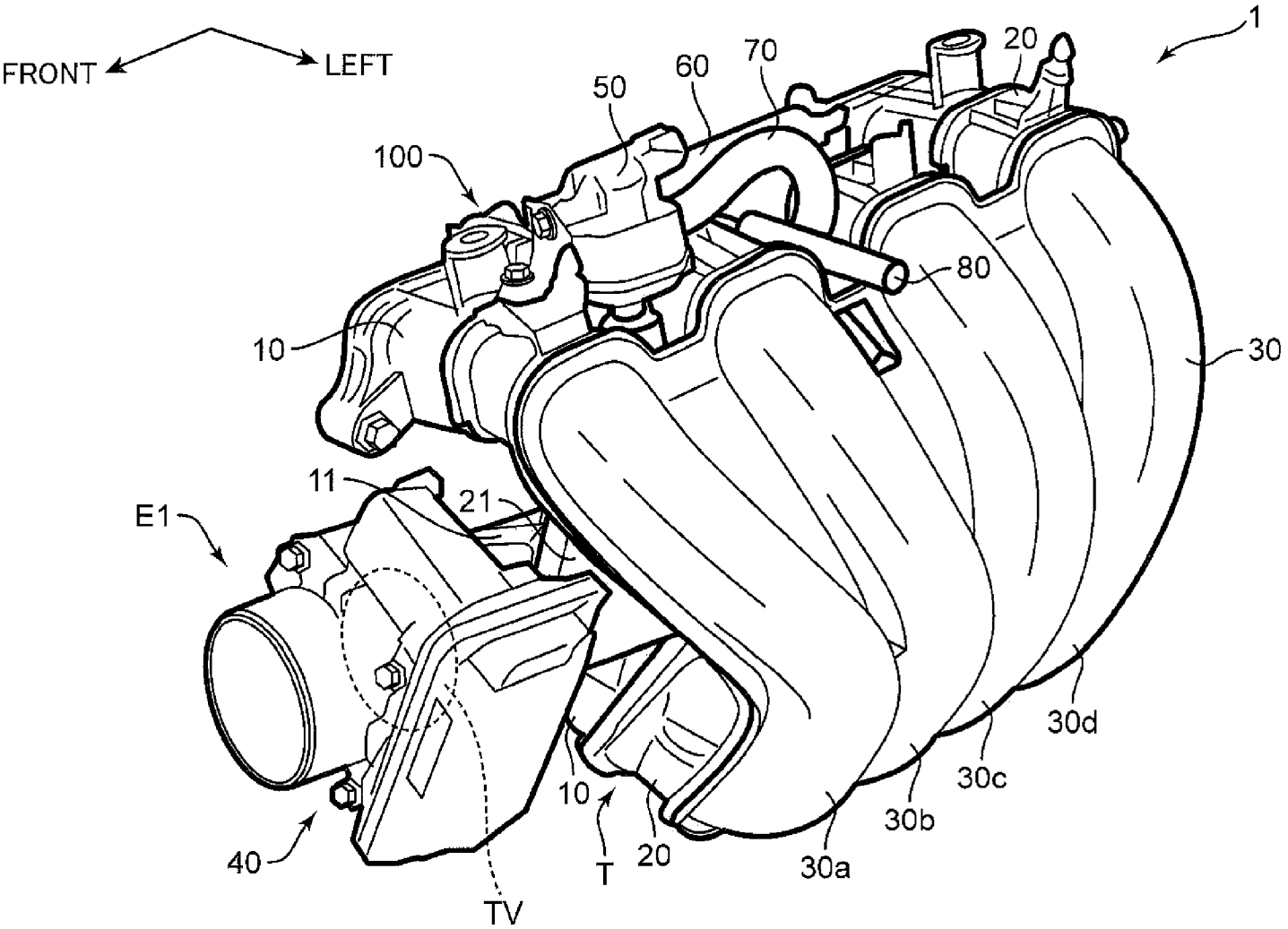
FIG. 2 is a perspective view of the intake manifold.

In the following, the embodiment is described in detail. In FIG. 1, the unillustrated engine is configured such that a first cylinder #1, a second cylinder #2, a third cylinder #3, and a fourth cylinder #4 are disposed in this order from the vehicle front side. Four branch pipe portions 30*a*, 30*b*, 30*c*, and 30*d* constituting upstream portions of independent intake passages a, . . . , a (see FIG. 3 to FIG. 5 and FIG. 8) which respectively communicate with the first, second, third, and fourth cylinders #1, #2, #3, and #4 are formed on the third divided piece 30. As illustrated in FIG. 2, upstream ends of the branch pipe portions 30*a*, 30*b*, 30*c*, and 30*d* are connected to the surge tank T.

Figure 6:
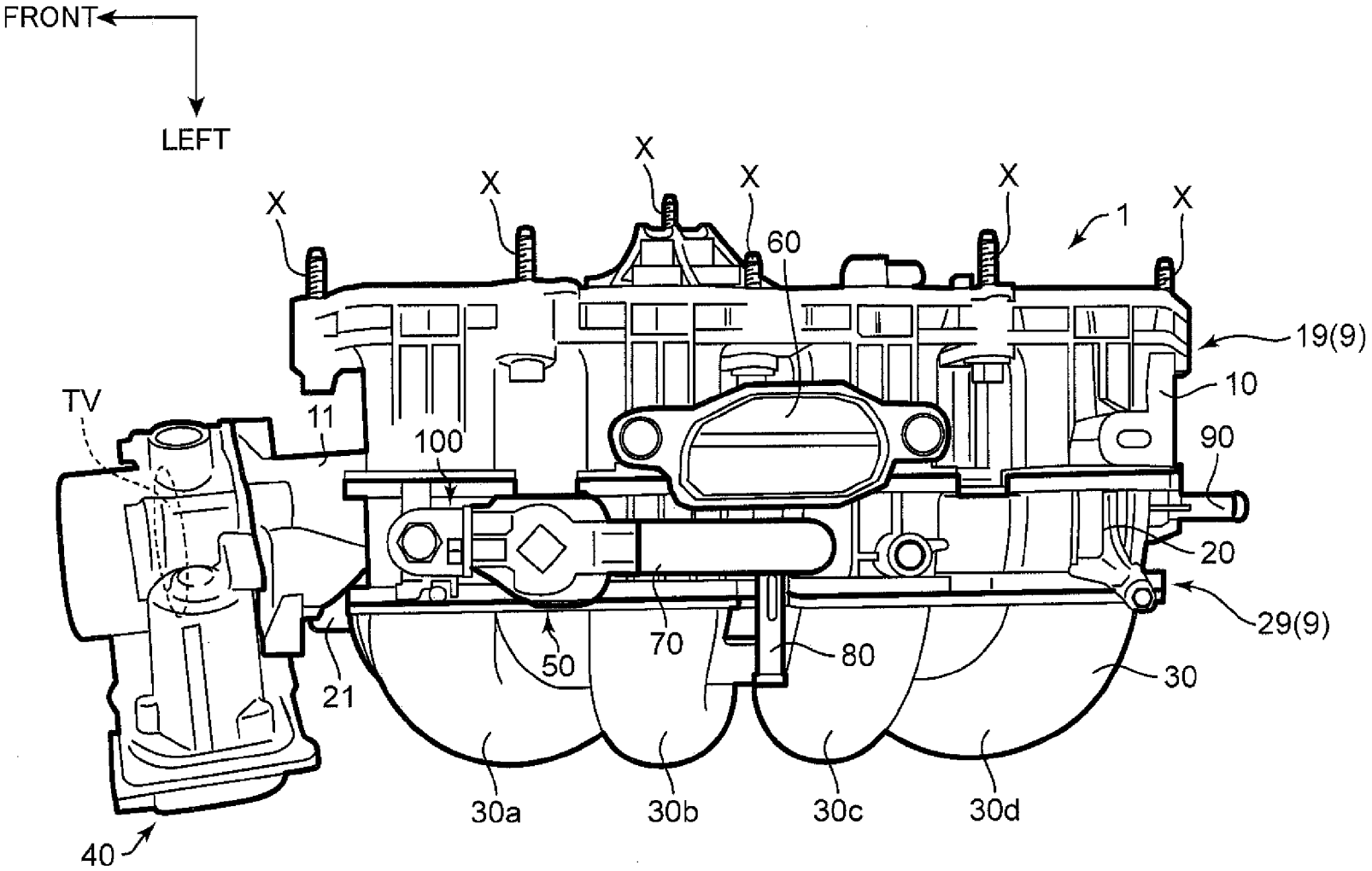
FIG. 6 is a top plan view of the intake manifold.

In FIG. 3, the reference signs P1 to P4 respectively indicate runners constituting downstream portions of the independent intake passages a, . . . , a. Specifically, the first runner P1 is provided for the first cylinder #1, the second runner P2 is provided for the second cylinder #2, the third runner P3 is provided for the third cylinder #3, and the fourth cylinder #4 is provided for the fourth cylinder #4. The surge tank T is constituted of a tank forming portion 10*t* of the first divided piece 10 illustrated in FIG. 3 and FIG. 4, and a tank forming portion 20*t* of the second divided piece 20 illustrated in FIG. 5. The engine mounting portion 9 is constituted of a mounting forming portion 19 of the first divided piece 10 illustrated in FIG. 3 and FIG. 4, and a mounting forming portion 29 of the second divided piece 20 illustrated in FIG. 5. As illustrated in FIG. 6 and FIG. 7, the intake manifold 1 is mounted on the engine by fastening bolts X via the engine mounting portion 9.

In FIG. 4 and FIG. 5, the reference signs S1 to S3 respectively indicate joint portions for mutually connecting the runners P1 to P4 adjacent to each other. Specifically, the first joint portion S1 connects between the first runner P1 and the second runner P2. The second joint portion S2 connects between the second runner P2 and the third runner P3. The third joint portion S3 connects between the third runner P3 and the fourth runner P4. As illustrated in FIG. 4 and FIG. 5, the joint portions S1 to S3 are recessed downward than the upper surfaces of the four runners P1 to P4 which bulge upward. Each of the mounting forming portion 19 of the first divided piece 10 and the mounting forming portion 29 of the second divided piece 20 is a portion such that the four runners P1 to P4 are arranged in the cylinder array direction, and relatively lower portions of the four runners P1 to P4 are mutually connected to the three joint portions S1 to S3 into a unit.

As illustrated in FIG. 5, the second divided piece 20 includes a bulging portion 21. The bulging portion 21 is a portion of the first connecting portion R1 constituting the second divided piece 20. The purge passage 51 is formed in the joint surface 20*m* of the bulging portion 21 of the second divided piece 20 which is joined to the first divided piece 10. As also illustrated in FIG. 1, FIG. 2, and FIG. 6, the bulging portion 21 bulges toward the throttle body 40, in other words, toward upstream of the intake passage E1, and is joined to a portion of the first connecting portion R1 constituting the first divided piece 10.

As illustrated in FIG. 4, an inlet hole 51*a* is formed in the purge passage 51, which is formed in the joint surface 10*m* of the first divided piece 10. The inlet hole 51*a* is formed in the single pipe portion 11. Downstream of the throttle valve TV of the intake passage E1 and the purge passage 51 are communicated with each other through the inlet hole 51*a*. In other words, one end of the purge passage 51 is connected to the purge gas supply hole 53 (see FIG. 5), and the other end of the purge passage 51 is connected to the inlet hole 51*a* (see FIG. 4).

The bulging portion 21 of the second divided piece 20 is curved in up and down directions in such a manner as to follow the outer surface of the single pipe portion 11 of the first divided piece 10.

In FIG. 5 and FIG. 6, the reference sign 90 indicates a suction pipe for drawing a negative pressure of the surge tank T to the outside of the intake manifold 1. The suction pipe 90 projects laterally from a side portion of the second divided piece 20. The negative pressure of the surge tank T is drawn to the suction pipe 90 via the communication path 91, which is formed inside the second connecting portion R2. In other words, one end of the communication path 91 is connected to the surge tank T, and the other end of the communication path 91 is connected to the suction pipe 90 (see FIG. 4 and FIG. 5).

To summarize the above, the first divided piece 10 is provided with, as main components, the throttle valve 40, the single pipe portion 11, the tank forming portion 10*t*, the mounting forming portion 19, the portion constituting the first connecting portion R1, and the portion constituting the second connecting portion R2 (see FIG. 4).

The second divided piece 20 is provided with, as main components, the bulging portion 21, the tank forming portion 20*t*, the mounting forming portion 29, the portion constituting the first connecting portion R1, and the portion constituting the second connecting portion R2 (see FIG. 5).

The third divided piece 30 is provided with, as main components, the four branch pipe portions 30*a*, 30*b*, 30*c*, and 30*d* (see FIG. 2).

In FIG. 8, the purge valve 50 is mounted on the upper surface of the intake manifold 1. A cylindrical purge valve mounting portion 25 stands upright at a position above the first joint portion S1, which is recessed downward between the first runner P1 and the second runner P2 included in the mounting forming portion 29 constituting the upper portion of the second divided piece 20. A cylindrical discharge portion (a portion through which purge gas of fuel vapor is discharged) 50*x* of the purge valve 50 is inserted in the purge valve mounting portion 25 from above through an opening upper surface of the purge valve mounting portion 25. Thus, the purge valve 50 is mounted on the intake manifold 1 (see FIG. 9).

The purge gas supply hole 53 is formed in the bottom surface of the purge valve mounting portion 25. As described above, one end of the purge passage 51 is connected to the purge gas supply hole 53.

Further, in FIG. 8, the purge valve 50 is fixed to the second divided piece 20. The fixing portion 120 is formed on the upper surface of the first runner P1 of the second divided piece 20. The purge valve 50 is fixed to the fixing portion 120 of the intake manifold 1, using the fixing mechanism 100 (constituted of the bracket 101, and the first and second fixing bolts 102 and 103) (see FIG. 7). In other words, the purge valve 50 is disposed on the second divided piece 20 interposed between the first divided piece 10 and the third divided piece 30 in a state that the purge valve mounting portion 25 and the fixing portion 120 are proximate to each other.

Figure 9:
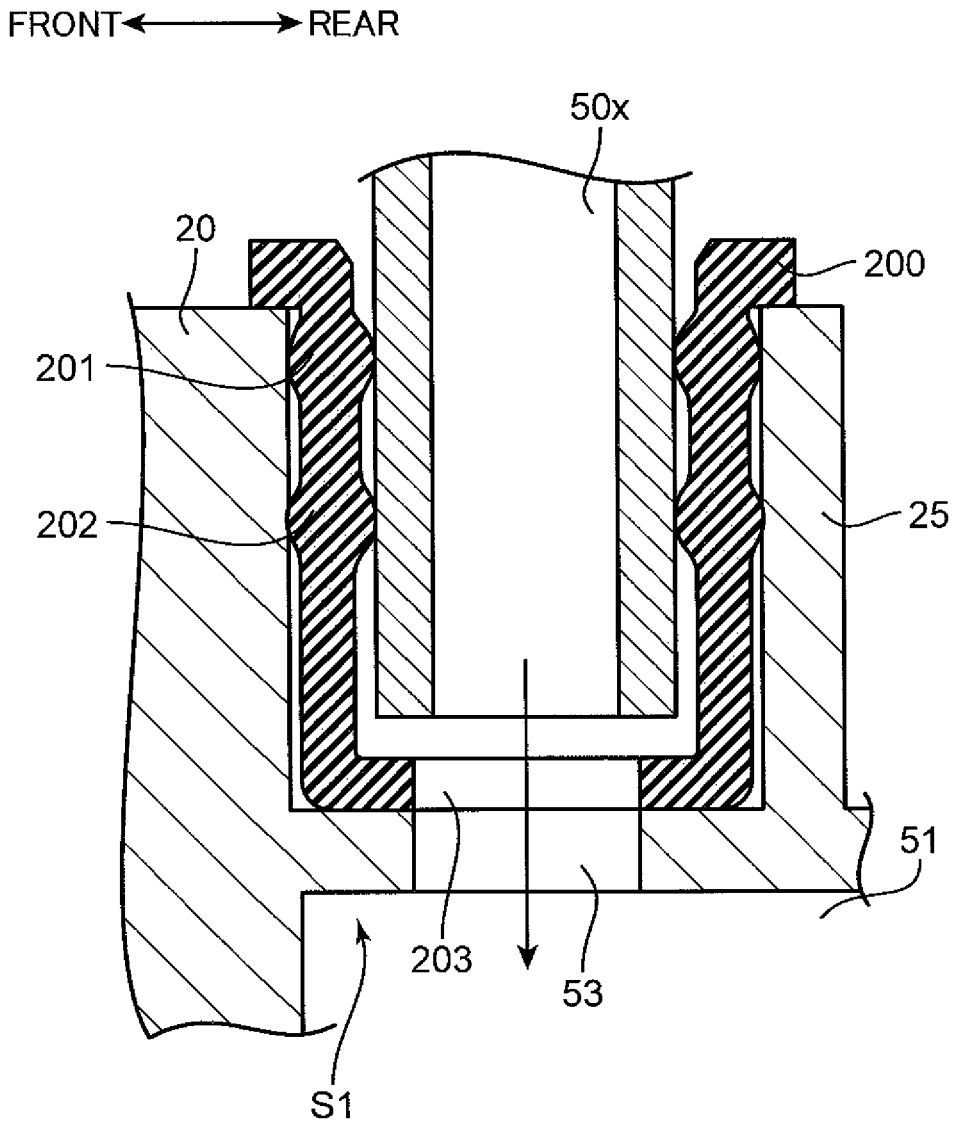
FIG. 9 is an enlarged elevational sectional view of a seal rubber member for use in mounting a purge valve on the intake manifold, and the periphery of the seal rubber member.

As enlargedly illustrated in FIG. 9, the discharge portion 50*x* of the purge valve 50 is inserted in the purge valve mounting portion 25 via the seal rubber member 200. In this example, the seal rubber member 200 includes the lip portions 201 and 202, each of which bulges radially, on both of the inner surface of the seal rubber member 200 in contact with the outer surface of the discharge portion 50*x* of the purge valve 50, and the outer surface of the seal rubber member 200 in contact with the inner surface of the purge valve mounting portion 25. This makes it possible to reduce the contact surface of the seal rubber member 200 with respect to the purge valve 50, and to reduce the contact surface of the seal rubber member 200 with respect to the purge valve mounting portion 25.

In FIG. 9, the reference sign 203 indicates a hole portion formed in the bottom surface of the seal rubber member 200 in order to flow purge gas of fuel vapor discharged from the discharge portion 50*x* of the purge valve 50 into the purge passage 51 through the purge gas supply hole 53 formed in the bottom surface of the purge valve mounting portion 25, as illustrated by the arrow in FIG. 9.

Further, in the aforementioned drawings, the reference sign 60 indicates a resonator that is integrally formed with a supply pipe 80 to be described later, and is communicated with the purge passage 51. The reference sign 70 indicates a supply hose connected to the purge valve 50. The reference sign 80 indicates a supply pipe connected to the supply hose. Fuel vapor and air are supplied to the purge valve 50 from a fuel tank (not illustrated) via the supply pipe 80 and the supply hose 70. The resonator 60 is mounted on the first divided piece 10 (see FIG. 6 and FIG. 7). The supply pipe 80 is supported on the resonator 60.

The following advantageous effects are obtained in the embodiment having the aforementioned configuration.

(1) The structure of the intake manifold 1 constituted of the divided pieces 10, 20, and 30 for an engine is provided with the gas supply hole 53 formed in a predetermined position of an outer surface of the intake manifold 1, and configured to supply predetermined gas from the outside of the intake manifold 1; and the gas inlet passage 51 formed in the joint surfaces 10*m* and 20*m* of the first and second divided pieces 10 and 20, and configured to guide the gas supplied through the gas supply hole 53 to a predetermined gas inlet position of the intake passage E1. According to this configuration, gas is guided through the gas supply hole 53 to the gas inlet position along the gas inlet passage 51 formed inside the intake manifold 1. This makes it possible to shorten the pipe on the outside of the intake manifold 1, and thus is advantageous in reducing the cost and the weight of the engine. Further, the gas inlet passage 51 is formed in the joint surfaces 10*m* and 20*m* of the first and second divided pieces 10 and 20. This makes it easy to form the gas inlet passage 51 inside the intake manifold 1.

(2) The purge valve 50 for regulating the amount of fuel vapor to be introduced to the intake passage E1 is mounted on the intake manifold 1. The gas supply hole 53 is a purge gas supply hole for supplying purge gas of fuel vapor to be discharged from the purge valve 50. The gas inlet passage 51 is a purge passage for guiding the purge gas supplied through the purge gas supply hole 53 to the downstream portion of the intake passage E1 with respect to the throttle valve TV. According to this configuration, the purge valve 50 is integrally mounted on the intake manifold 1, and the purge passage 51 is formed inside the intake manifold 1. This makes it possible to shorten the pipe of a fuel vapor processing device.

(3) The purge valve 50 is mounted on the first joint portion S1, which is recessed between the runners P1 and P2 of the intake manifold 1 adjacent to each other. This is advantageous in mounting the purge valve 50 on the intake manifold 1 rigidly and in a compact manner.

(4) The intake manifold 1 includes the throttle body 40 provided with the throttle valve TV, the single pipe portion 11 formed downstream of the throttle body 40, the engine mounting portion 9, and the first connecting portion R1 for connecting between the single pipe portion 11 and the engine mounting portion 9. The purge gas supply hole 53 is formed in the engine mounting portion 9. The purge passage 51 is formed in the joint surfaces 10*m* and 20*m* of the first and second divided pieces 10 and 20 constituting the first connecting portion R1. This makes it possible to securely guide the purge gas supplied to the engine mounting portion 9 of the intake manifold 1 to downstream of the throttle valve TV, utilizing the first connecting portion R1.

(5) The intake manifold 1 further includes the surge tank T formed downstream of the single pipe portion 11, and the second connecting portion R2 for connecting between the surge tank T and the engine mounting portion 9. The communication path 91 for communicating between the surge tank T and the outside of the intake manifold 1 is formed in the joint surfaces 10*m* and 20*m* of the first and second divided pieces 10 and 20 constituting the second connecting portion R2. Therefore, for instance, it is possible to guide blow-by gas to the surge tank T via the communication path 91, which is formed utilizing the second connecting portion R2. Alternatively, it is possible to draw a negative pressure of the surge tank T to the outside of the intake manifold 1 via the communication path 91. For instance, it is possible to use the drawn negative pressure for a master cylinder of a braking device (not illustrated).

(6) The divided pieces include the first divided piece 10, the second divided piece 20, and the third divided piece 30. The structure of the intake manifold is further provided with the first joint portion 111 formed by joining the joint flange 10*f* of the first divided piece 10 and the joint flange 20*f* of the second divided piece 20; the second joint portion 112 formed by joining the joint flange 20*f* of the second divided piece 20 and the joint flange 30*f* of the third divided piece 30; the fixing member (i.e. the fixing portion 120 and the bridge portions 110, 110) formed on the second divided piece 20 while bridging over the first joint portion 111 and the second joint portion 112; and the bracket 101 for fixing the purge valve 50 to the fixing member. This makes it possible to increase the rigidity in mounting the purge valve 50. This is advantageous in reducing diffusion of operating noise of the purge valve 50.

(7) The purge valve 50 is mounted on the intake manifold 1 via the seal rubber member 200. The seal rubber member 200 includes the lip portions 201 and 202 on both of the surface of the seal rubber member 200 facing the purge valve 50 and the surface of the seal rubber member 200 facing the intake manifold 1. This makes it possible to reduce the contact surface of the seal rubber member 200 with respect to the purge valve 50, and to reduce the contact surface of the seal rubber member 200 with respect to the intake manifold 1. This is advantageous in obstructing transmission of operating noise of the purge valve 50 to the intake manifold 1, and in reducing diffusion of operating noise of the purge valve 50.

In the embodiment, purge gas of fuel vapor is introduced to the intake passage E1. The invention is also applicable to a case, in which blow-by gas or EGR gas is introduced to the intake passage E1.

Further, in the embodiment, the lip portions 201 and 202 are formed on both of the inner surface and the outer surface of the seal rubber member 200. Alternatively, the lip portions 201 and 202 may be formed on either one of the inner surface and the outer surface of the seal rubber member 200.

The present invention described above will be outlined as follows.

An aspect of the invention provides a structure of an intake manifold constituted of a plurality of divided pieces for an engine. The structure of the intake manifold includes a gas supply hole formed in a predetermined position of an outer surface of the intake manifold, and configured to supply predetermined gas from an outside of the intake manifold; and a gas inlet passage formed in predetermined joint surfaces of the divided pieces, and configured to guide the gas supplied through the gas supply hole to a predetermined gas inlet position of an intake passage.

According to the aforementioned configuration, gas is guided through the gas supply hole to the gas inlet position along the gas inlet passage formed inside the intake manifold. This makes it possible to shorten the pipe on the outside of the intake manifold, and thus is advantageous in reducing the cost and the weight of the engine. Further, the gas inlet passage is formed in the joint surfaces of the divided pieces. This makes it easy to form the gas inlet passage inside the intake manifold.

Specifically, according to the aforementioned configuration, it is possible to shorten the pipe on the outside of the intake manifold for introducing purge gas of fuel vapor to the intake passage. This provides a structure of an intake manifold for an engine, which enables to reduce the cost and the weight of the engine.

Preferably, the structure of the intake manifold may be further provided with a purge valve mounted on the intake manifold, and configured to regulate an amount of fuel vapor to be introduced to the intake passage. The gas supply hole may be a purge gas supply hole which supplies purge gas of fuel vapor to be discharged from the purge valve. The gas inlet passage may be a purge passage which guides the purge gas supplied through the purge gas supply hole to a downstream portion of the intake passage with respect to a throttle valve.

According to the aforementioned configuration, the purge valve is integrally mounted on the intake manifold, and the purge passage is formed inside the intake manifold. This makes it possible to shorten the pipe of a fuel vapor processing device.

Preferably, the purge valve may be mounted on a joint portion recessed between runners of the intake manifold adjacent to each other.

According to the aforementioned configuration, the purge valve is mounted on the intake manifold rigidly and in a compact manner.

Preferably, the intake manifold may include a throttle body provided with the throttle valve, a single pipe portion formed downstream of the throttle body, an engine mounting portion, and a connecting portion which connects between the single pipe portion and the engine mounting portion. The purge gas supply hole may be formed in the engine mounting portion. The purge passage may be formed in the joint surfaces of the divided pieces constituting the connecting portion.

According to the aforementioned configuration, it is possible to securely introduce the purge gas supplied to the engine mounting portion of the intake manifold to downstream of the throttle valve, utilizing the connecting portion.

Preferably, the intake manifold may further include a surge tank formed downstream of the single pipe portion, and a second connecting portion which connects between the surge tank and the engine mounting portion. The intake manifold may further include a communication path formed in the joint surfaces of the divided pieces constituting the second connecting portion, and configured to communicate between the surge tank and the outside of the intake manifold.

According to the aforementioned configuration, for instance, it is possible to introduce blow-by gas to the surge tank via the communication path, which is formed utilizing the second connecting portion. Alternatively, it is possible to draw a negative pressure of the surge tank to the outside of the intake manifold via the communication path.

Preferably, the divided pieces may include a first divided piece, a second divided piece, and a third divided piece. The intake manifold may further include a first joint portion formed by joining a joint flange of the first divided piece and a joint flange of the second divided piece; a second joint portion formed by joining the joint flange of the second divided piece and a joint flange of the third divided piece; a fixing member formed on the second divided piece while bridging over the first joint portion and the second joint portion; and a bracket which fixes the purge valve to the fixing member.

According to the aforementioned configuration, it is possible to increase the rigidity in mounting the purge valve. This is advantageous in preventing diffusion of operating noise of the purge valve.

Preferably, the purge valve may be mounted on the intake manifold via a seal rubber member. The seal rubber member may include a lip portion formed on at least one of a surface of the seal rubber member facing the purge valve, and a surface of the seal rubber member facing the intake manifold.

According to the aforementioned configuration, it is possible to reduce the contact surface of the seal rubber member with respect to the purge valve, or to reduce the contact surface of the seal rubber member with respect to the intake manifold. This is advantageous in obstructing transmission of operating noise of the purge valve to the intake manifold, and in reducing diffusion of operating noise of the purge valve.

This application is based on Japanese Patent Application No. 2014-178927 filed in Japan Patent Office on Sep. 3, 2014, the contents of which are hereby incorporated by reference.

While the invention of the present application has been described appropriately and fully by way of the embodiment as described above with reference to the drawings in order to express the present invention, it should be appreciated that any one skilled in the art can readily change and/or modify the embodiment described above. Therefore, it should be understood that a changed embodiment or a modified embodiment implemented by any one skilled in the art is included within the scope of the appended claims unless the changed embodiment or the modified embodiment is of a level that deviates from the scope of the appended claims.

What is claimed is:

1. A structure of an intake manifold constituted of a plurality of divided pieces for an engine, comprising:

a gas supply hole formed in a predetermined position of an outer surface of the intake manifold, and configured to supply predetermined gas from an outside of the intake manifold;

a gas inlet passage formed in predetermined joint surfaces of the divided pieces, and configured to guide the gas supplied through the gas supply hole to a predetermined gas inlet position of an intake passage;

a purge valve mounted on the intake manifold, and configured to regulate an amount of fuel vapor to be introduced to the intake passage, wherein the gas supply hole is a purge gas supply hole which supplies purge gas of fuel vapor to be discharged from the purge valve, the gas inlet passage is a purge passage which guides the purge gas supplied through the purge gas supply hole to a downstream portion of the intake passage with respect to a throttle valve, the purge valve is mounted on a joint portion recessed between runners of the intake manifold adjacent to each other, the intake manifold includes a throttle body provided with the throttle valve, a single pipe portion formed downstream of the throttle body, an engine mounting portion, and a connecting portion which connects between the single pipe portion and the engine mounting portion, the purge gas supply hole is formed in the engine mounting portion, the purge passage is formed in the joint surfaces of the divided pieces constituting the connecting portion, the intake manifold further includes a surge tank formed downstream of the single pipe portion, and a second connecting portion which connects between the surge tank and the engine mounting portion, and the intake manifold further includes a communication path formed in the joint surfaces of the divided pieces constituting the second connecting portion, and configured to communicate between the surge tank and the outside of the intake manifold.

2. The structure of the intake manifold for an engine according to claim 1, wherein the divided pieces include a first divided piece, a second divided piece, and a third divided piece, the intake manifold further includes:

a first joint portion formed by joining a joint flange of the first divided piece and a joint flange of the second divided piece;

a second joint portion formed by joining the joint flange of the second divided piece and a joint flange of the third divided piece;

a fixing member formed on the second divided piece while bridging over the first joint portion and the second joint portion; and a bracket which fixes the purge valve to the fixing member.

3. The structure of the intake manifold for an engine according to claim 1, wherein the purge valve is mounted on the intake manifold via a seal rubber member, and the seal rubber member includes a lip portion formed on at least one of a surface of the seal rubber member facing the purge valve, and a surface of the seal rubber member facing the intake manifold.

4. A structure of an intake manifold, comprising:

a plurality of divided pieces;

an engine mounting portion;

a gas supply hole formed in the engine mounting portion in a predetermined position of an outer surface of the intake manifold, and configured to supply predetermined gas from an outside of the intake manifold;

a passage formed in predetermined joint surfaces of the plurality of divided pieces at a location downstream from the gas supply hole;

a single pipe portion formed downstream of the passage;

a first connecting portion formed by the plurality of divided pieces which connects between the single pipe portion and the engine mounting portion, and the passage is formed in the joint surfaces of the divided pieces constituting the first connecting portion;

a surge tank formed downstream of the single pipe portion;

a second connecting portion which connects between the surge tank and the engine mounting portion, the second connecting portion formed by the plurality of divided pieces; and a communication path formed in the joint surfaces of the divided pieces constituting the second connecting portion, the communication path configured to communicate between the surge tank and the outside of the intake manifold.

5. A structure of an intake manifold, comprising:

a plurality of divided pieces;

a first intake runner;

a second intake runner;

a joint portion extending between the first intake runner and the second intake runner, the joint portion positioned in a offset downward location with respect to the first intake runner and the second intake runner;

a gas supply hole formed in an outer surface of the joint portion;

a gas inlet passage partially formed in the joint portion in a single piece of the plurality of divided pieces, and partially formed by the plurality of divided pieces at a location downstream from the joint portion, and the gas inlet passage positioned downstream from the gas supply hole; and a purge valve mounted on the joint portion upstream from the gas inlet passage such that the gas supply hole is positioned directly between the gas inlet passage and the purge valve.

* * * * *